United States Patent [19]

Guerin

[11] Patent Number: 4,553,366

[45] Date of Patent: Nov. 19, 1985

[54] FIXATION DEVICE FOR AN ARTIFICIAL STONE PLATE FACING ON A WALL STRUCTURE

[76] Inventor: Gabriel Guerin, 49350 Gennes, France

[21] Appl. No.: 468,632

[22] Filed: Feb. 22, 1983

[30] Foreign Application Priority Data

Feb. 25, 1982 [FR] France ..... 82 03362

[51] Int. Cl.[4] ..... E04B 1/38

[52] U.S. Cl. ..... 52/487; 52/508; 52/511

[58] Field of Search ..... 52/487, 391, 386, 479, 52/508, 510, 511, 512

[56] References Cited

U.S. PATENT DOCUMENTS

| | | | |
|---|---|---|---|
| 3,550,337 | 12/1970 | Lorenz | 52/510 |
| 3,672,107 | 6/1972 | Santry | 52/511 |
| 3,705,002 | 12/1972 | Varlonga | 52/487 |
| 4,262,464 | 4/1981 | Ladowici | 52/510 |

FOREIGN PATENT DOCUMENTS

| | | | |
|---|---|---|---|
| 2044961 | 3/1972 | Fed. Rep. of Germany . | |
| 662944 | 8/1929 | France | 52/391 |
| 2308746 | 11/1976 | France | 52/487 |
| 2323838 | 4/1977 | France . | |
| 392825 | 10/1965 | Switzerland | 52/511 |

*Primary Examiner*—Henry E. Raduazo

*Attorney, Agent, or Firm*—Young & Thompson

[57] ABSTRACT

The present invention relates to fixation devices, on a wall structure, and at a distance of said structure, of a facing made of the assembly of a number of modular plates.

The plates are provided with two series of metallic hooking means rigidly connected with the plate along lines parallel to the top and bottom edges, the hooks of said means opening downwardly and supporting elements fixed to the wall and having two parallel horizontal hooking edges turned upwardly, the hooks of the metallic hooking means being conformed so as to cooperate with said hooking edges.

2 Claims, 10 Drawing Figures

FIXATION DEVICE FOR AN ARTIFICIAL STONE PLATE FACING ON A WALL STRUCTURE

Figure 1:
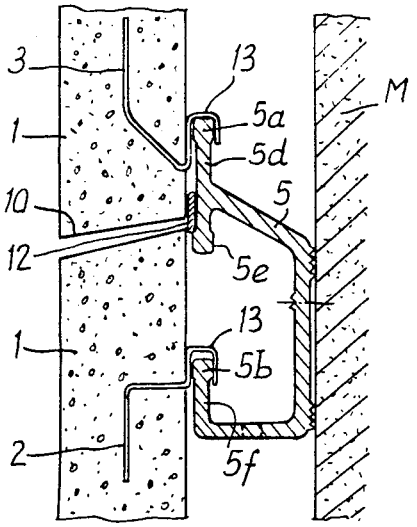

The present invention relates to fixation devices, on a wall structure, and at a distance of said structure, of a facing made of the assembly of a number of modular elements.

Several modes of fixation of plates or pannels used for providing an outer facing on a structure forming the framework of a building are already known. This facing generally situated at a distance of the wall in order to put in place, between the facing and the wall, a heat and possibly acoustic insulation. Particularly, a technique is known from German patent DE-A-2 044 961 consisting in hooking up artificial stone tiles on horizontal metallic sections fixed to the wall, the tiles comprising as suspension means retaining stirrups, hook-shaped, with their opening turned downwardly and the base of which is embedded in the plate, adjacent the upper edge thereof, said retaining stirrups engaging an upward directed wing of a horizontal metallic section. In this type of facing, one has not only to hang up the plate, but also to secure it against perpendicular displacement relative to the facade and make the joints between the facade plates, necessarily laid with a clearance, weather-proof in all the measure possible. In German patent DE-A-2 044 961, only the problem of the securing against perpendicular displacement is imperfectly solved by a junction stirrup which is protruding downwardly along the lower edge of the plate, said junction stirrup, when in place, engaging behind the edge of the plate of the lower bed. The displacement of the lower edge of the plate in the direction of the wall is in fact prevented by the abutment of the chamfered rear face of said edge against the chamfered front face of the upper edge of the lower bed plate or plates, and, due to the clearances, there remains the possibility of a large backlash or beat of the plate bringing about a risk of degradation. The fixation device disclosed in this patent does not allow to seal the joints.

The fixation device according to the invention avoids said disadvantages and provides a secure hooking up of artificial stone tiles on a wall while preserving the facility of mounting and use.

According to the invention, the fixation device combines support elements fixed to the wall and having two horizontal and parallel hooking edges, extending upwardly, and two series of metallic hooking means, made integral with the plate along lines parallel to the top and bottom edges, the hooks of said means opening downwardly being shaped so as to cooperate with said hooking edges.

With the fixation device according to the invention, the two top and bottom hookings are performed between metallic elements, thereby authorizing a greater precision of the interlocking between the hook and the hooking edge and therefore an almost non-existent clearance, thereby avoiding the "beat" and providing a greater mechanical strength.

The support elements are preferably made of sections disposed horizontally and extending over the whole length of the wall, thereby making easy their positioning, but it is also possible to use iron fittings having hooking edges of limited width.

The hooking means are preferably made of inserts, the portion forming the hook as such being rigidly connected to a base embedded in the artificial stone tile when casting it and as disclosed in patent DE-A-2 044 961. The inserts can be sections extending on the major portion of the width of the plate, but they can also be limited to elements of reduced length. Particularly in the latter case, and in order to adapt more easily standard plates, by cutting them, to the singular shapes of the lay-out, several series of hooking means can also be distributed over the height of the plate.

According to a further feature of the invention, on the horizontal section is formed, from its upper hooking edge, a wing the height of which is superior to the distance between the bottom of the hooks of the series of lower hooking means and the bottom edge of the plate, so that said wing protrudes behind the top edge of the plate of the lower bed while remaining slightly set back. Said wing can form a support for a plastic seal forming a tight seal between the horizontal edges of the plates.

According to a further feature, the lower edge of the hereabove wing forms a hooking edge so as to permit using the section in a reverse position for plate bed which does not comprise a lower bed.

According still to another feature of the invention, thin plaquettes are provided for being hooked up vertically between two successive horizontal sections in the region of the vertical joint between two contiguous plates and for being applied behind the contiguous edges of said plates. Said thin plaquettes, preferably metallic in nature, can carry a plastic seal forming a tight seal between the vertical edges of the plates.

Figure 2:
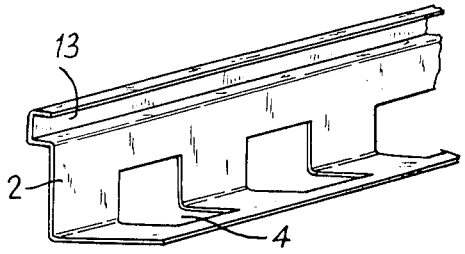
Figure 3:
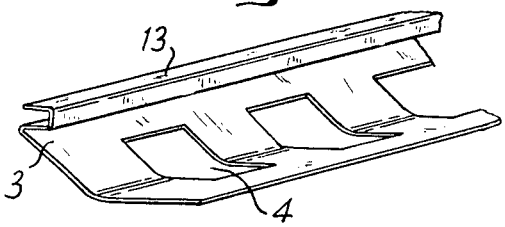
Figure 4:
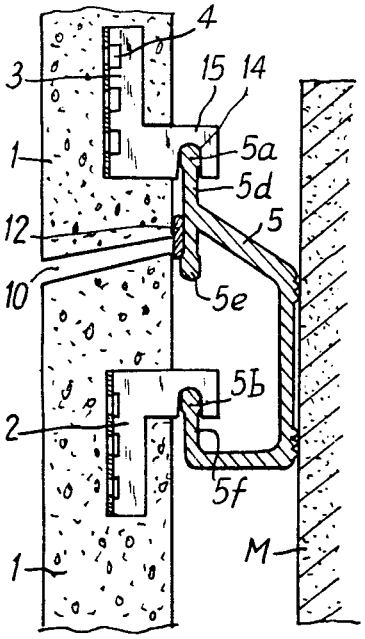
Figure 5:
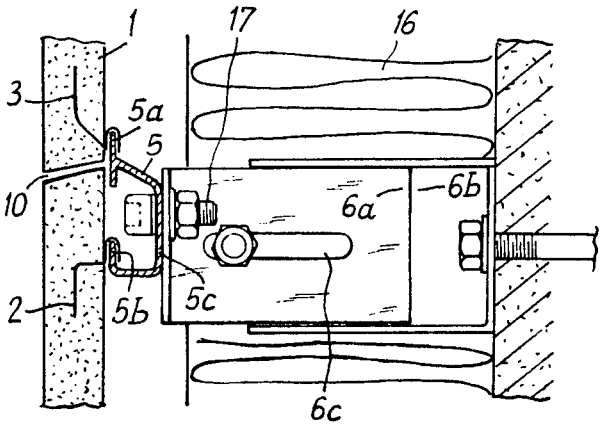
Figure 6:
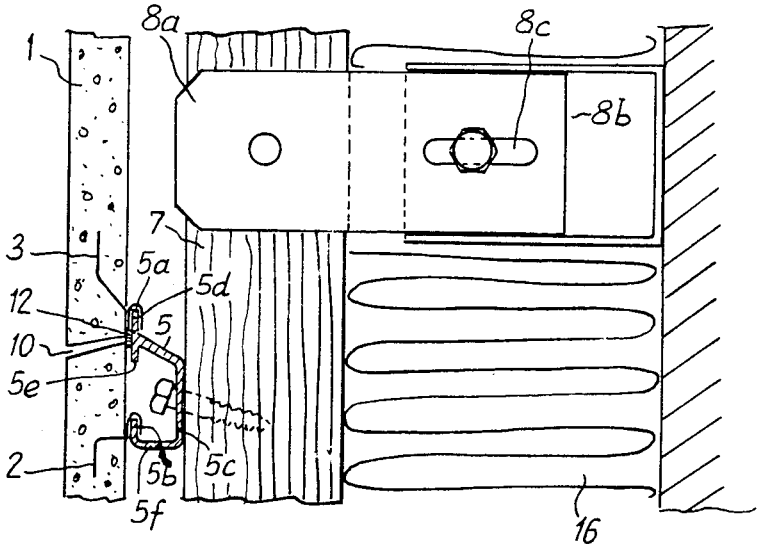
Figure 7:
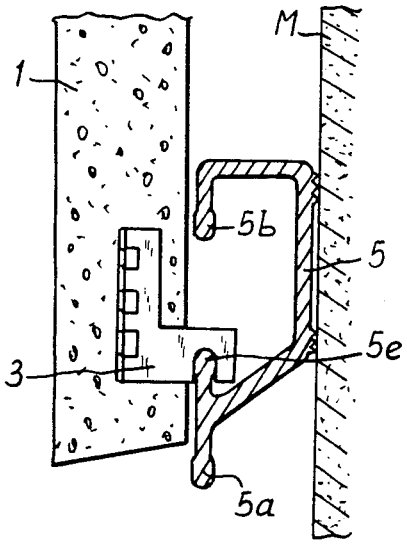
Figure 8:
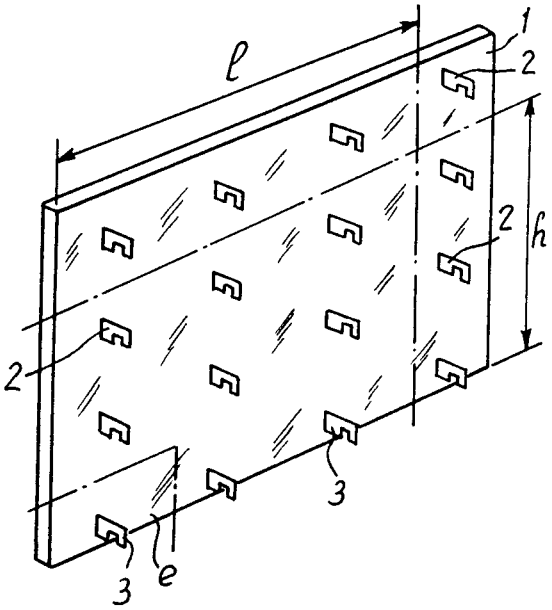
Figure 9:
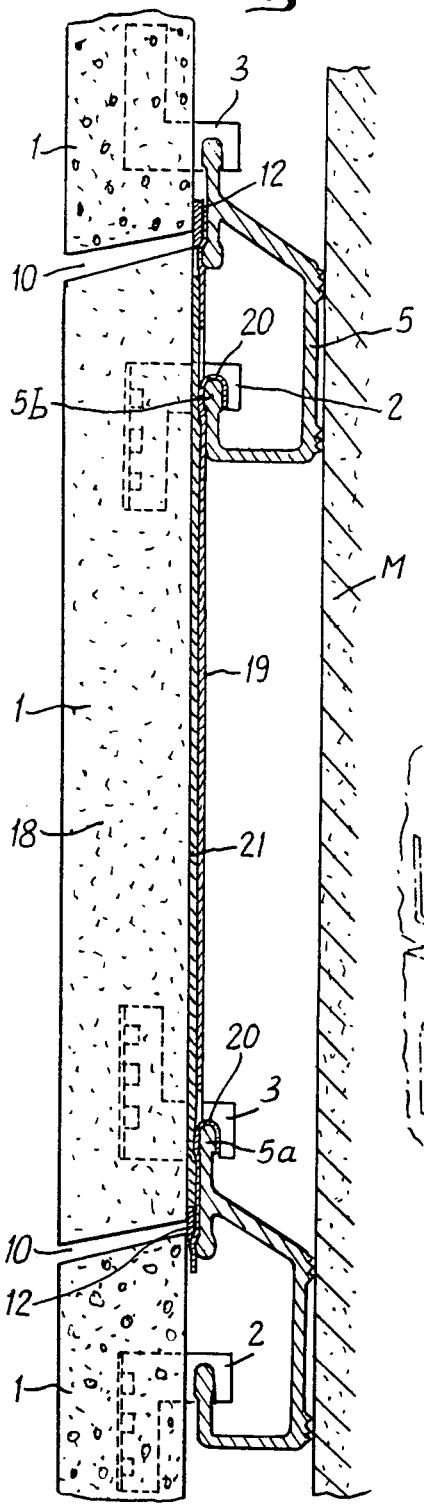
Figure 10:
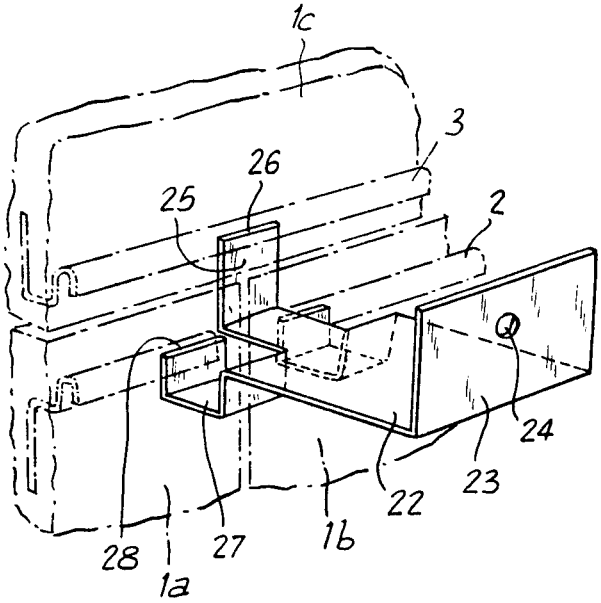

The invention will become more apparent from the following description of several embodiments of the fixation device of artificial stone facing plates, with reference to the drawings wherein:

FIG. 1 is a sectional view of the fixation device of the facing plates directly on the wall structure of a building, according to a first embodiment, FIG. 2 is an isometric projection view of the metallic section forming the insert providing the upper hooking means of each plate in the example shown in FIG. 1, FIG. 3 isometric protection view of the metallic section forming the insert providing the lower hooking means of each plate in the example shown in FIG. 1, FIG. 4 is a view corresponding to FIG. 1 of an alternative embodiment of the hooking elements, FIG. 5 and 6 are sectional views of two alternative fixations of the facing plates allowing maintaining said plates at a distance from the wall structure in order to form an outer insulation, FIG. 7 is a view corresponding to FIG. 4 of the lower bed of the plate, FIG. 8 is a rear elevation view of a facing plate according to another embodiment especially designed for an adaptation to the singular points, FIG. 9 is a vertical sectional view in the region of a joint between two contiguous plates, and FIG. 10 is a rear view of an iron fitting forming another embodiment of the invention.

The facing or boarding plates 1 forming the facing modular elements are provided by molding of a mixture of cement, quartz grains, silica, pigments and a fluidization medium favouring the molding operation. Each plate, of rectangular or square shape, has its edges oblique, the angle of obliqueness of the opposed edges being different; as an example and for the horizontal edges as well as for the vertical edges, one of them is slanting by an angle of 10° for example while the other which is opposite is slanting by an angle of 14° , these angle values having of course a non limiting character. This arrangement promotes drainage and running of the rain water in the vertical or horizontal jointing lines.

According to the invention, inserts made of metallic elements and preferably of stainless steel, provided for forming the upper 2 and lower 3 hooking means, are incorporated during the molding stage. Each of said metallic elements is formed, in the region to be embedded in the thickness of the plate, with perforations 4 the object of which is to provide a perfect implantation of the inserts in the mortar by an interpenetration of said mortar in the metallic section, thereby preventing said inserts from being pulled out after the setting is completed. This good resistance against being pulled out is on the other hand improved by the configuration of the embedded portion of the metallic element, said portion forming an angle which is right, acute or obtuse with the plane normal to the plate in order to resist, under any circumstances, the stresses being exerted on the insert. The protruding portion of the insert forms a hook turned downwardly and which can be formed by a channel 13 in the case of an insert formed of a section extending over the length of the plate, as shown in FIG. 2 and 3, or a cut-out 14 where the protruding portion of the insert forms a vertical plaquette 15 perpendicular to the rear face of the plate as shown in FIG. 4.

The hooks of the insert protruding portions interlock with the edges of the wings of a hooking section 5, preferably of aluminium.

According to the invention, said section has two hooking edges 5*a*, 5*b* turned upwardly, the cross-section of which corresponds to that of the hook of inserts 2 and 3. The C-shaped core of the section includes a plane central portion 5*c*, parallel to the plane passing by the two hooking edges, for its fixation on a support formed by the wall M or by intermediate fixation members described in more detail hereafter. The upper hooking edge 5*a* is formed by the edge of a wing 5*d* which extends downwardly beyond joint 10 between the two plates 1 superimposed up to a lower edge 5*e* which is below the joint 10. The two front and rear faces of the wing are thinned-out in order to limit the bearing between the insert hook and edge 5*a* to a few millimeters and to create a housing for a plastic seal 12 making the horizontal joint 10 tight. The lower wing 5*f* reaching edge 5*b* is thinned-out in the same way in order to limit the bearing between the insert hook and said edge 5*b*.

As shown in FIG. 5 and 6, the horizontal section 5 can be attached to the wall through the agency of iron fittings in order to form between the wall and the plates 1 a space allowing inserting an insulation layer 16, for example of glass wool, which is isolated from the the plates by a sheet of ventilation air. In the case of FIG. 5, the hooking section 5 is fixed on a metallic support in two portions 6*a* and 6*b* which are assembled by a bolt housed inside an oblong button-hole 6*c* allowing extension of the support and its setting at the required distance. The section 5 is fixed on said iron fitting by means of a bolt 17 or similar. In FIG. 6, the section 5 is fixed on a wooden cleat 7 forming one of the vertical uprights of a grid supporting the insulation, said cleat being in turn fixed on one of the portions 8*a* of a support which is assembled with the other portion 8*b* pegged in the wall by means of a bolt housed in a button-hole 8*c* allowing a positioning and setting operation identical to the case of FIG. 5.

In the particular case of the last lower layer of covering plates and as shown in FIG. 7, said plates have their lower inserts 3 hooked onto the double wings 5*e* of the aluminium hooking section 5 placed in a reversed position.

The plate shown in FIG. 8 is provided for facilitating the realization of the plates which have a particular shape for the lay-out, viz. the facing plates which can have a reduced height h or width l and/or which have to be formed with cut-outs e in order to adapt to the corner of an embrasure. As depicted, several horizontal series of inserts 2 which are preferably, and in order to avoid to have to cut out the inserts, of the type described in FIG. 4, are distributed over the height of the plate, their spacing being such that the section on which the inserts of the upper series are hooked, after the cutting operation, do not interfere with those of the series underneath.

As hereabove described, a plastic seal 12 can be placed at the level of the horizontal joints 10 between wing 5*d* and the rear faces of plates 1, but vertical joints 18 remain between adjacent plates and said joints are disposed according to a staggered arrangement. In all the embodiments, the inserts 2–3 leave a vertical band free along the vertical edges of the plates. Therefore, it is possible to hook in, for example between the edges 5*b* and 5*a* of the top and bottom hooking horizontal sections on which the plate bed is hooked, a thin metallic plaquette 19 having hooks 20 and presenting on its front face a plastic seal 21 which makes the vertical joint tight so as, in combination with seals 12, to make the layer of facing plates water-tight and wind-tight.

In the embodiment of FIG. 10, the supporting element is formed of an iron fitting 22 placed at the meeting point of the joints between two lower plates 1*a*, 1*b*, and an upper plate 1*c* shown in chain-dot lines. References 2 and 3 designate the upper and lower inserts of said plates. The iron fitting 22 includes a base lug 23 perpendicular to the core and formed with a hole 24 for a fixation peg on the wall or the supporting element. The core carries a lug 25 turned upwardly and having an upper edge 26 and two side lugs 27, U-shaped so that their upper edges 28 be parallel to edge 26, the spacing between the edges 26 and 28 being equal to the spacing between the hooking edges 5*a*, 5*b* in section 5. In this case and instead of the inserts disposed over the whole width of the plate, with the exception of the edges, it would be possible to use three inserts formed with a pocket and disposed for each tile in the axis of the lower edge and close to the ends of the upper edge. With such inserts the pockets of which interlock with the three lugs 25 and 27, there is obtained a blocking preventing any lateral displacement. A plurality of pocketed inserts can be provided with the same disposition as inserts 2 and 3 of FIG. 8, for obtaining the same result.

The device which is the object of the invention can be used for providing any covering of a wall structure comprising or not an outer insulation.

I claim:

1. A fixation device of a facing made of artificial stone plates on a wall structure, comprising plates provided with two series of metallic hooking means extending along lines parallel to the top and bottom edges of said plates, said metallic hooking means comprising sections with a base embedded in the artificial stone plate when said plate is being cast, the hooks of said means having a hooking part facing downwardly and supporting elements to be fixed to the wall formed of sections disposed horizontally and extending over the whole width of the wall, said sections having two parallel horizontal hooking edges turned upwardly, :e hooks of the metallic hooking means being so form as to cooperate with said hooking edges and the secti comprising, from its upper hooking edge, a wing t height of which is greater than the spacing betwe the hooking part of the lower hooking means and : lower edge of the plate, so that said wing extends hind the top edge of the plate hooked on the lower hooking edge of the same section.

2. A device according to claim 1, wherein a plastic seal is carried by the front surface of the wing comprising the upper hooking edge of the section, said seal extrending behind the top edge of the plate hooked on the lower hooking edge of the same section in order to make tight the horizontal joint between the horizontal edges of plates.

* * * * *